US010309381B2

(12) United States Patent
DeArman et al.

(10) Patent No.: US 10,309,381 B2
(45) Date of Patent: Jun. 4, 2019

(54) DOWNHOLE MOTOR DRIVEN RECIPROCATING WELL PUMP

(71) Applicant: Baker Hughes Incorporated, Houston, TX (US)

(72) Inventors: Carroll Scott DeArman, Owasso, OK (US); Carlos A. Prieto, Katy, TX (US); Gary L. Williams, Broken Arrow, OK (US); David L. Garrett, Bartlesville, OK (US); Shawn N. Gunter, Owasso, OK (US); Nathan G. Nelson, Glenpool, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 685 days.

(21) Appl. No.: 14/579,585

(22) Filed: Dec. 22, 2014

(65) Prior Publication Data

US 2015/0176574 A1 Jun. 25, 2015

Related U.S. Application Data

(60) Provisional application No. 61/920,292, filed on Dec. 23, 2013, provisional application No. 61/985,614, filed on Apr. 29, 2014.

(51) Int. Cl.
*F04B 17/03* (2006.01)
*F04B 47/06* (2006.01)
(Continued)

(52) U.S. Cl.
CPC ..... *F04B 17/03* (2013.01); *F04B 7/02* (2013.01); *F04B 47/06* (2013.01); *F04B 47/12* (2013.01);
(Continued)

(58) Field of Classification Search
CPC ..... F04B 17/03–17/048; F04B 47/06; F04B 47/12; F04B 7/02; F04B 39/0016; E21B 43/128
(Continued)

(56) References Cited

U.S. PATENT DOCUMENTS 3,677,665 A * 7/1972 Corkill ..... E21B 43/128 417/410.3
4,272,226 A 6/1981 Osborne
(Continued)

FOREIGN PATENT DOCUMENTS

GB 2037364 A 7/1980
GB 2037364 B 10/1982
RU 2425253 C1 7/2011

OTHER PUBLICATIONS

Reciprocating Submersible Pump Improves Oil Production, JPT—Jul. 2012—www.jptonline.org.
(Continued)

*Primary Examiner* — Devon C Kramer
*Assistant Examiner* — Stephen Mick
(74) *Attorney, Agent, or Firm* — Bracewell LLP; James E. Bradley

(57) ABSTRACT

A submersible well pump assembly has a pump housing with a pump discharge on upper end. A pump barrel is located within the pump housing, defining an annular passage between the barrel and the pump housing. A plunger is reciprocally carried in the barrel. A motor mounted below the pump housing and operatively couples to the plunger causes the plunger to reciprocate between an upstroke and a down-stroke. A valve and porting arrangement directs well fluid in the barrel below the plunger into the annular passage and out the discharge during a down stroke of the plunger. The valve and porting arrangement admits well fluid into the barrel below the plunger during the up stroke of the plunger. A connecting rod extends between the motor and the plunger. The connecting rod is in tension during the down-stroke.

20 Claims, 9 Drawing Sheets

(51) Int. Cl.

| | |
|---|---|
| ***F04B 47/12*** | (2006.01) |
| ***F04B 7/02*** | (2006.01) |
| *F04B 39/10* | (2006.01) |
| *F04B 39/00* | (2006.01) |

(52) U.S. Cl.
CPC ..... *F04B 39/0016* (2013.01); *F04B 39/1006* (2013.01)

(58) Field of Classification Search
USPC ..... 417/415, 417, 422, 554
See application file for complete search history.

(56) References Cited

U.S. PATENT DOCUMENTS

| | | | | |
|---|---|---|---|---|
| 4,350,478 | A * | 9/1982 | Oldershaw | F04B 47/12 417/417 |
| 4,687,054 | A | 8/1987 | Russell et al. | |
| 4,815,949 | A * | 3/1989 | Rabson | H02K 41/03 310/14 |
| 5,622,222 | A * | 4/1997 | Wilson | E21B 41/02 166/105.4 |
| 5,734,209 | A | 3/1998 | Hallidy | |
| 5,831,353 | A | 11/1998 | Bolding et al. | |
| 6,015,270 | A | 1/2000 | Roth | |
| 6,155,792 | A | 12/2000 | Hartley et al. | |
| 6,283,720 | B1 | 9/2001 | Kottke | |
| 6,926,504 | B2 | 8/2005 | Howard | |
| 7,445,435 | B2 | 11/2008 | Howard | |
| 7,686,075 | B2 | 3/2010 | Stewart et al. | |
| 8,291,979 | B2 | 10/2012 | Oddie | |
| 2005/0109516 | A1 | 5/2005 | Wilson | |
| 2006/0266526 | A1 | 11/2006 | Ocalan et al. | |
| 2007/0114015 | A1* | 5/2007 | Shen | E21B 43/128 166/105 |
| 2010/0329893 | A1* | 12/2010 | Martinez | E21B 43/128 417/53 |
| 2014/0105759 | A1 | 4/2014 | Henry et al. | |

OTHER PUBLICATIONS

Decision of Grant from corresponding RU 2016129900/03 dated Jul. 16, 2018.

* cited by examiner

DOWNHOLE MOTOR DRIVEN RECIPROCATING WELL PUMP

CROSS REFERENCE TO RELATED APPLICATIONS

This application claims priority to provisional application 61/920,292, filed Dec. 23, 2013 and to provisional application 61/985,614, filed Apr. 29, 2014.

FIELD OF THE DISCLOSURE

This disclosure relates in general to reciprocating well pumps and in particular to a reciprocating well pump operated by a downhole electrical motor.

BACKGROUND

Many oil wells require pumping in order to produce the well fluid. One common type employs a reciprocating downhole pump. A sucker rod extends down the well to the plunger of the pump. A lifting mechanism at the surface strokes the sucker rod to lift the well fluid. Extending a sucker rod string down to a pump is problematic for deep wells and wells where the pump is located in an inclined lower portion.

Rotary pumps driven by a downhole electrical motor are also utilized to a large extent. The pump may be a centrifugal pump having many stages of impellers and diffusers. Rotary oil well pumps also include progressing cavity pumps, in which a rotor rotates within an elastomeric stator. The rotor and the stator have helical contours.

Also, various proposals have been made to drive a reciprocating pump with a downhole electrical motor. One type employs a motor that rotates a drive shaft. A helical screw mechanism converts the rotation to linear to stroke the pump. In another type proposed, a linear motor is employed to stroke the pump. The linear motor has electromagnet coils and a mover with permanent magnets located within a bore of the coil assembly. When energized with one type of pulse, the mover strokes linearly in one direction. Another type of pulse causes the mover to stroke in an opposite direction.

For various reasons, reciprocating pumps with downhole electrical motors are not in commercial use to any extent.

SUMMARY

The submersible well pump assembly disclosed herein has a pump housing with a pump discharge on upper end. A pump barrel is located within the pump housing, defining an annular passage between the barrel and the pump housing. A plunger is reciprocally carried in the barrel. A motor is mounted below the pump housing and operatively coupled to the plunger for causing the plunger to reciprocate between an upstroke and a down-stroke. A valve means within the pump housing directs well fluid in the barrel below the plunger into the annular passage and out the discharge during a down stroke of the plunger. The valve means admits well fluid into the barrel below the plunger during the up stroke of the plunger.

The valve means comprises a barrel outlet port below the plunger that places well fluid in the barrel in fluid communication with well fluid in the annular passage. A connecting rod extends between the motor and the plunger. The connecting rod is in tension during the down-stroke. The valve means may also comprises a well fluid inlet at the upper end of the pump housing that admits well fluid from an exterior of the assembly into the pump housing.

In some of the embodiments, the well fluid inlet is in fluid communication with an interior of the barrel above the plunger. The well fluid inlet may direct well fluid from the inlet into the barrel above the plunger during the upstroke of the plunger as well as the down-stroke.

In some of the embodiments, a plunger passage extends axially through the plunger. A traveling valve is mounted to the plunger for movement therewith. The traveling valve opens the plunger passage to allow well thud in the interior of the barrel to flow downward through the plunger passage during the upstroke. The traveling valve closes during the down-stroke, preventing well fluid below the plunger from flowing upward through the plunger passage.

In some of the embodiments, the motor has a motor outer housing and a motor inner housing mounted concentrically in the motor outer housing. The motor inner housing has a smaller outer diameter than an inner diameter of the motor outer housing, defining a windings chamber. A coil winding is located within the windings chamber and immersed within a dielectric fluid contained in the windings chamber. A mover is located within the motor inner housing, the mover comprising a shaft with a plurality of magnets extending along a length of the shaft. Electrical power supplied to the coil winding causes the mover to move linearly along the axis. The mover is operatively coupled to the plunger for causing the upstroke and down-stroke movement of the plunger.

An expansion chamber may be coupled to the motor outer housing. The expansion chamber has a movable element that contains a dielectric fluid. The movable element is movable in response to a difference between well fluid pressure exterior of the expansion chamber and the dielectric fluid pressure. A dielectric fluid communication passage leads from the expansion chamber into the windings chamber in fluid communication with the dielectric fluid in the windings chamber. The motor may have a motor well fluid passage extending into the interior of the motor inner housing, immersing the mover in well fluid.

BRIEF DESCRIPTION OF THE DRAWING

So that the manner in which the features, advantages and objects of the disclosure, as well as others which will become apparent, are attained and can be understood in more detail more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to oilier equally effective embodiments.

DETAILED DESCRIPTION OF THE DISCLOSURE

Figure 1:
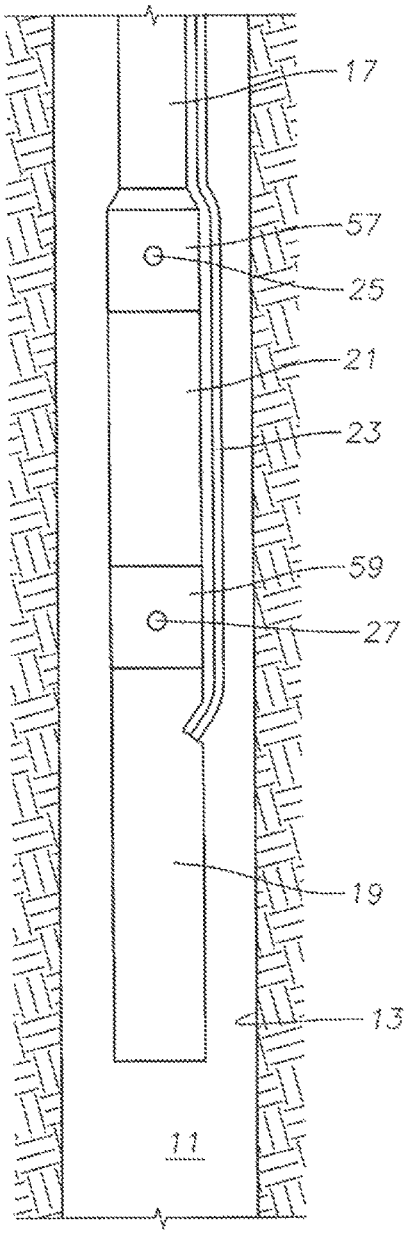
FIG. 1 is a side view of a first embodiment of an electrical submersible pump assembly in accordance with this disclosure and installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well 11 has casing 13 that is perforated to admit well fluid. A pump assembly 15 is illustrated as being supported on production tubing 17 extending into well 11. Alternately, pump assembly 15 could be supported by other structure, such as coiled tubing. Although shown installed vertically, pump assembly 15 could be located within an inclined or horizontal section of well 11. Pump assembly 15 could be employed to feed well fluid to the intake of an upper pump assembly (not shown) located above.

Pump assembly 15 includes a linear motor 19 connected to a lower end of a reciprocating pump 21. The terms "upper" and "lower" are used herein for convenience only since pump assembly 15 could be oriented horizontally. A power cable 23 extends downward from a wellhead to motor 19 to supply power. In this example, pump assembly 15 is double acting, having an upper intake 25 and a lower intake 27, both of which are located above linear motor 19. Alternately, pump assembly 15 could be single acting, and if so, preferably the power stroke that lifts the well fluid up tubing 17 occurs during the down-stroke, and the fill stroke to admit fluid to the pump 21 during the upstroke.

Figure 5A:
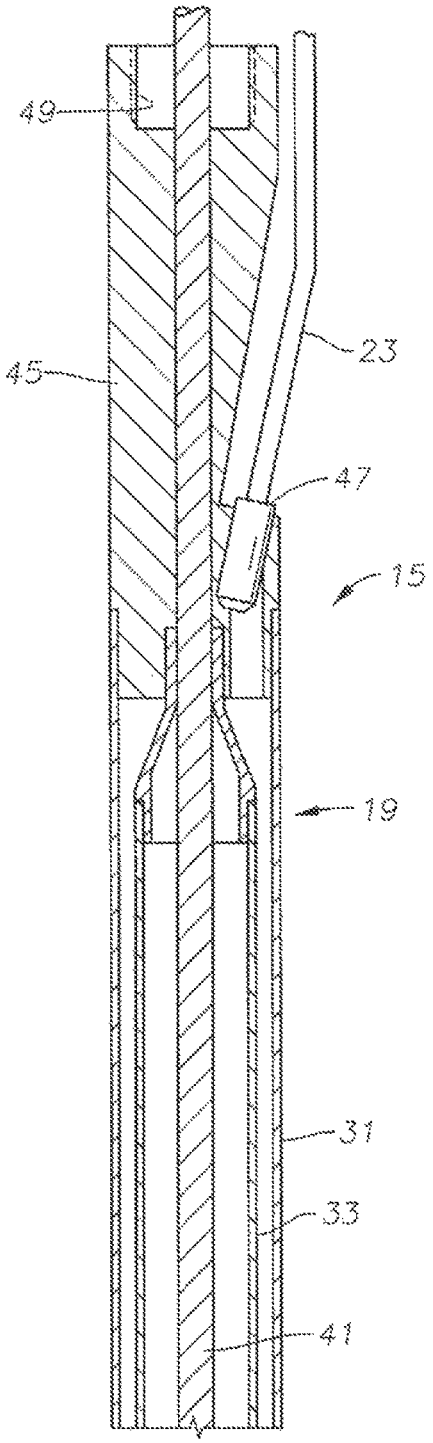
FIGS. 5A and 5B comprise a sectional view of the linear motor of the pump assembly of FIG. 1.
Figure 5B:
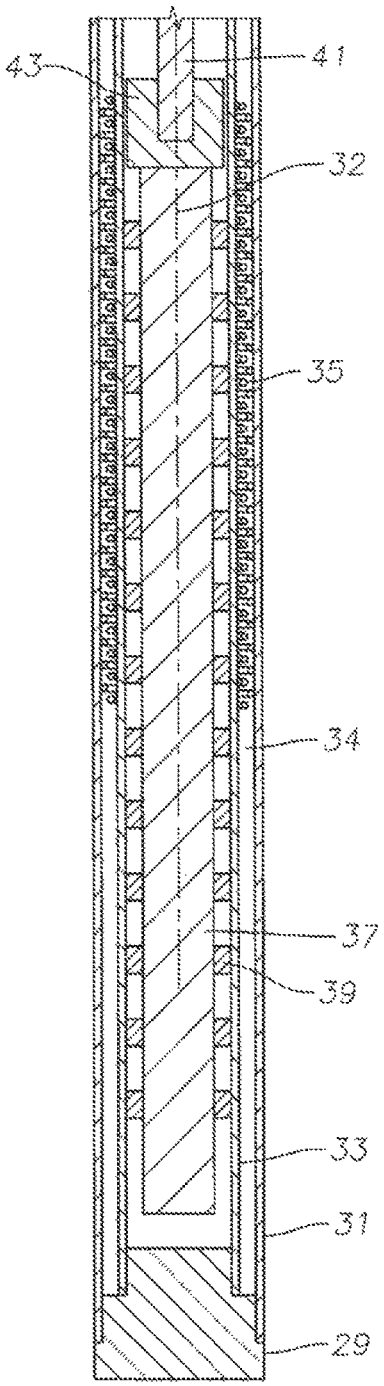

Referring to FIG. 5B, motor 19 has a lower end or base 29. A cylindrical outer housing 31 has a lower end that secures to base 29. A cylindrical inner housing 33 is concentrically mounted to base 29 within outer housing 31 along a longitudinal axis 32 of pump assembly 15. A set of electromagnetic coils or windings 35 are located in an annular space 34 between inner and outer housings 33, 31. Coils 35 may be in a slotted or slot-less arrangement. The lower end of coils 35 is spaced above base 29 a selected distance.

A mover 37 within inner housing 33 comprises a shaft having permanent magnets 39 along its length. Mover 37 moves linearly in inner housing 33 along axis 32 in response to an electromagnetic field generated by coils 35 affecting magnets 39. A control circuit (not shown) located adjacent to a wellhead cycles power supplied to coils 35 to cause mover 37 to stroke upward and downward. The distance from the uppermost magnet 39 to the lowermost magnet 39 is about twice the axial length of coils 35. Alternately, the axial distance between the uppermost and lowermost magnets 39 could be one-half the axial length of coils 35. Magnets 39 are illustrated as having outer diameters greater than mover 37. Magnets 39 may slidingly engage the inner surface of inner housing 33, however, they do not form seals with inner housing 33. Magnets 33 may be magnetized radially, axially, or in a Halbach arrangement.

A dielectric lubricant optionally may be located in inner housing 33 that is sealed from well fluid on the exterior of motor 19. If so, the stroking of mover 37 does not cause pumping action of any lubricant in inner housing 33. Similarly, a sealed dielectric fluid may be located in annular space 34 between inner housing 33 and outer housing 31, and optionally sealed from any lubricant within inner housing 33. Optionally, a pressure equalizer or expansion chamber (not shown) will communicate hydrostatic well fluid pressure to any lubricant and/or dielectric fluid contained in outer housing 31 and inner housing 33.

A connecting rod 41 located on axis 32 couples to mover 37 with a connector 43. Referring to FIG. 5A, inner housing 33 sealingly secures to the lower end of a motor head 45. Connecting rod 41 extends through the upper end of inner housing 33 and through motor head 45. Connecting rod 41 extends sealingly through an axial passage in motor head 45. Power cable 23 connects to motor 19 with a power cable connector 47. Motor leads (not shown) extend from power cable connector 47 through annular space 34 to coils 35. Motor head 45 has a connector 49 on its upper end that may comprise threads, either internal, as shown, or external. Alternately, a bolted flange connection may be employed.

Figure 2A:
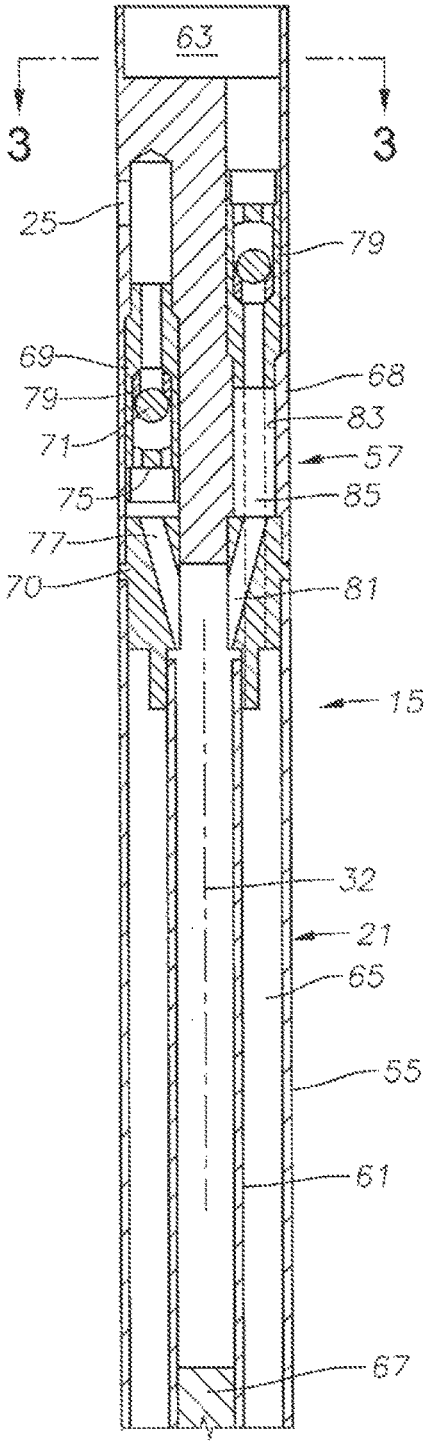
FIGS. 2A and 2B comprise a sectional view of the pump of the pump assembly of FIG. 1.
Figure 2B:
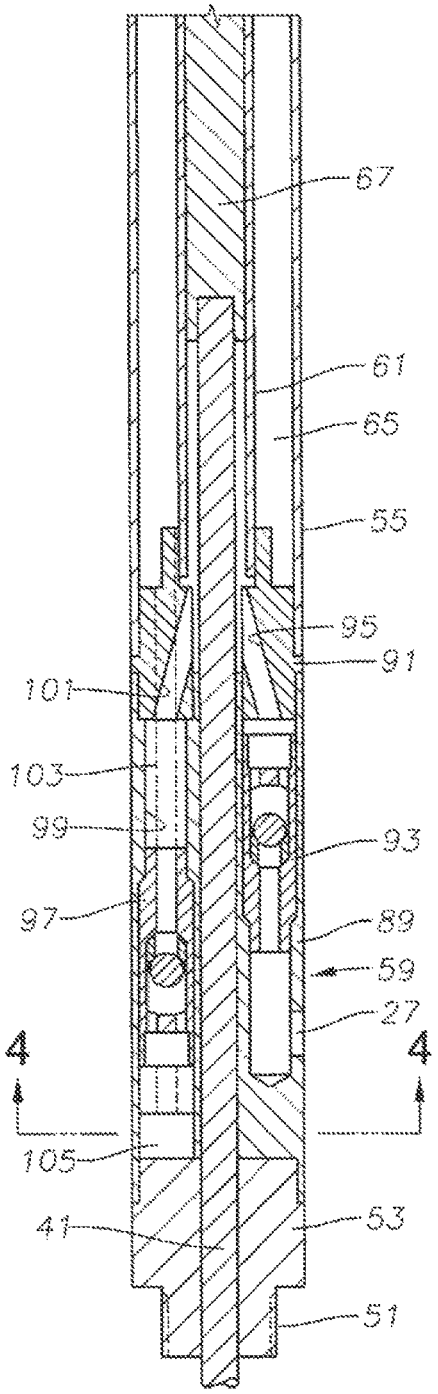

Referring to FIG. 2B, pump 21 has a pump base 53 on its lower end that couples to motor connector 49, such as by threads or by a bolted flange connection. Pump 21 has a pump housing 55 that is cylindrical and concentric relative to axis 32. Pump 21 has an upper valve assembly 57, which contains upper intake 25, and a lower valve assembly 59, which contains lower intake 27. A barrel 61 extends concentrically between upper valve assembly 57 and lower valve assembly 59 within pump housing 55. Upper valve assembly 57 connects to production tubing 17 (FIG. 1) and has a pump discharge passage 63 on its upper end that is in communication with the interior of tubing 17. Pump housing 55 and barrel 61 define a pump annulus 65 between them. A pump piston or plunger 67 slidingly engages the inner diameter of barrel 61. Connecting rod 41 connects to the lower end of plunger 67 to cause plunger 67 to stroke in unison with motor mover 37 (FIG. 5B).

Upper valve assembly 57 includes an upper valve body 68 having an upper intake valve 69 that is in a passage parallel to and offset from axis 32. Upper intake valve 69 is a cheek valve that may be of a variety of types. In this example, upper intake valve 69 has a ball 71 that moves between a seat 73 above it and a cage 75 below. Upper intake 25 is above and leads downward to seat 73 of upper intake valve 69.

An upper crossover member 70 secures between upper valve body 68 and the upper end of pump housing 55 with threaded connections or by a flanged connection. Upper crossover member 70 could be integrally formed with upper valve body 68. Upper crossover member 70 has an upper crossover intake passage 77 that extends upward and outward from the lower to the upper end of upper crossover member 70. Upper crossover intake passage 77 has a lower end in fluid communication with the interior of barrel 61 and an upper end in fluid communication with the lower side of upper intake valve 69. When plunger 67 strokes downward, ball 71 rests on cage 75 and well fluid flows through upper intake 25, upper intake valve 69 and into barrel 61 above plunger 67.

Upper valve assembly 57 has an upper discharge valve 79 that is offset from axis 32 in a direction opposite from upper intake valve 69. Upper discharge valve 79 may be identical to upper intake valve 69 but inverted. An upper crossover discharge passage 81 in upper crossover member 70 extends upward and outward from the interior of barrel 61 to an upper discharge valve bore 83 in upper valve body 68. Upper discharge vale bore 83 extends to pump discharge passage 63. Upper discharge valve 79 is mounted in upper discharge valve bore 83, and when plunger 67 strokes upward, well fluid in barrel 61 above plunger 67 flows through upper crossover discharge passage 81, upper discharge valve 79 and into pump discharge passage 63.

Figure 3:
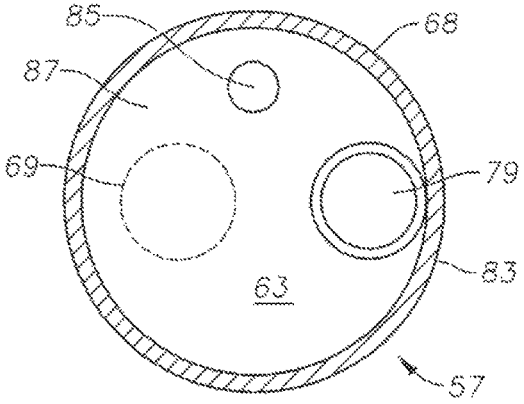
FIG. 3 is a transverse sectional view of the pump of FIG. 2, taken along the line 3-3 of FIGS. 2A and 2B.

As shown by the dotted lines in FIG. 2A and in the transverse cross-sectional view of FIG. 3, au annulus upper passage 85 extends from annulus 65 through upper crossover member 70 and valve body 68 to pump discharge passage 63. Annulus upper passage 85 is parallel to and offset from axis 32 and upper discharge valve bore 83. The upper end of annulus upper passage 85 is in fluid communication with the upper end of upper discharge valve bore 83 above upper discharge valve 79. In this example, annulus upper passage 85 extends to pump discharge passage 63, as shown in FIG. 3.

Referring to FIG. 2B, lower valve assembly 59 has a lower valve body 89 that secures, such as a by a threaded connection, to pump base 53. A lower crossover member 91 secures to the upper end of lower valve body 89 and the lower end of pump housing 55. A lower intake valve 93 that may be identical to but inverted relative to upper intake valve 69 (FIG. 5A) is mounted in lower valve body 89 offset from axis 32. Lower intake valve 93 is above and in fluid communication with lower intake 27. A lower crossover intake passage 95 in lower crossover member 91 has an upper end in fluid communication with the interior of barrel 61 below plunger 67. Lower crossover intake passage 95 extends downward and outward from barrel 61 to lower intake valve 93. When plunger 67 moves in the upstroke, well fluid flows through lower intake 27, lower intake valve 93 and lower crossover intake passage 95 to barrel 61 below plunger 67.

A lower discharge valve 97 is mounted in a lower discharge valve bore 99 in lower valve body 89 parallel to and 180 degrees offset from lower intake valve 93. Lower discharge valve 97 may be identical to upper discharge valve 79 but inverted. A lower crossover discharge passage 101 is in fluid communication with the discharge side of lower discharge valve 97. Lower crossover discharge passage 101 extends upward and inward through lower crossover member 91 offset from lower crossover intake passage 95. The upper end of lower crossover discharge passage 101 extends from the interior of barrel 61 below plunger 67 to lower discharge valve bore 99 above lower discharge valve 97.

Figure 4:
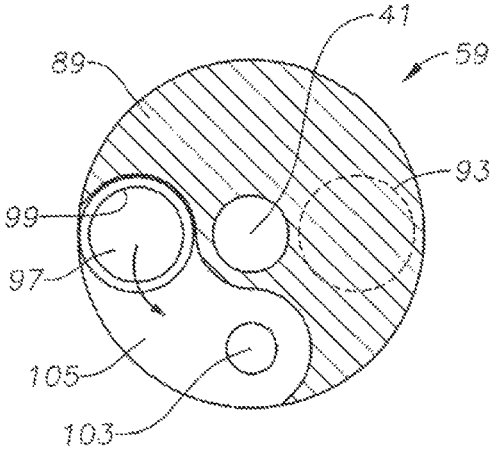
FIG. 4 is a transverse sectional view of the pump of FIG. 2, taken along the line 4-4 for FIGS. 2A and 2B.

The discharge or lower side of lower discharge valve 97 is in fluid communication with an annul us lower passage 103 (shown by dotted lines) that extends through lower crossover member 91. Annulus lower passage 103 communicates the lower side of discharge valve 97 with annulus 65. Annulus lower passage 103 is parallel to and offset from lower discharge valve bore 99, as shown in FIG. 4. A linking passage 105 in lower valve body 89 extends partially in a circumferential direction to connect the lower ends of lower discharge valve bore 99 and annulus lower passage 103 with each other.

In operation of the embodiment of FIGS. 1-5, a control circuit supplies alternating current power in a phased manner to coils 35 to interact with magnets 39 to produce linear movement along axis 32 of motor mover 37 (FIG. 5B). Motor mover 37 causes linear movement of pump plunger 67 (FIGS. 2A and 2B). Assuming that the movement is in an upstroke direction, well fluid flows in lower intake 27, through lower intake valve 93 and lower crossover intake passage 95 to the interior of barrel 61 below plunger 67. Well fluid in barrel 61 above plunger 67 from a previous down-stroke is pushed upward during the upstroke through upper crossover discharge passage 81 and upper discharge valve 79 to pump discharge passage 63. The well fluid in pump discharge passage 63 flows upward into production tubing 17 (FIG. 1).

The upward movement of well fluid in barrel 61 during the upstroke of plunger 67 does not flow out upper intake 25 because upper intake valve 69 will close, with ball 71 seating against seat 73. Similarly, during the upstroke, well fluid being discharged into pump discharge 63 does not flow down annulus upper passage 85 into annulus 65 because the discharge pressure in pump discharge 63 will communicate with lower discharge valve 97 to close. This discharge pressure in pump discharge 63 communicates with annulus 65, which communicates with the lower side of lower discharge valve 97 via annulus lower passage 103, linking passage 105 and lower discharge valve bore 99. Thus during the upstroke of plunger 67, lower intake valve 93 and upper discharge valve 79 are open and lower discharge valve 97 and upper intake valve 69 are closed.

Sensors (not shown) will signal the control circuit when motor mover 37 is reaching the upper end of the upstroke. The controller (not shown) coordinates the power to coils 35 to cause mover 37 to begin a down-stroke. During the down-stroke, well fluid flows in upper intake 25 through upper intake valve 69 and upper crossover intake passage 77 to the interior of barrel 61. At the same time, well fluid in barrel 61 below plunger 67 will be pushed out during the down-stroke. The well fluid being pushed out flows through lower crossover discharge passage 101 and through lower discharge valve 97 and linking passage 105 to annulus lower passage 103. The well fluid flows up annulus lower passage 103 into annulus 65. The well fluid flows from annulus 65 through annulus upper passage 85 to pump discharge passage 63 and up production tubing 17 (FIG. 1).

The discharge pressure during the down-stroke does not cause well fluid to flow out lower intake 27 because it will cause lower intake valve 93 to close. The discharge pressure in pump discharge 63 during the down-stroke does not cause well fluid to flow through upper discharge valve 79 because it will close upper discharge valve 79. Thus, during the down-stroke, lower discharge valve 97 and upper intake valve 69 are open and upper discharge valve 79 and lower intake valve 93 are closed. During the down-stroke, connecting rod 41 is in tension even though the down-stroke is a power stroke causing well fluid to be lifted in production tubing 17.

Figure 6:
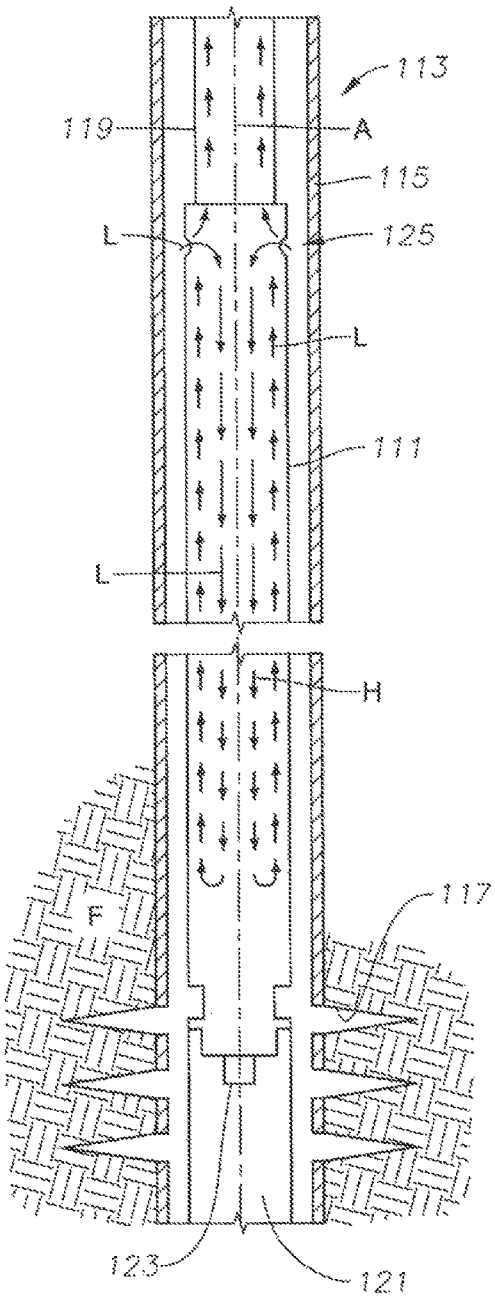
FIG. 6 is a schematic view of a second embodiment of an electrical submersible pump assembly in accordance with this disclosure and installed in a well.
Figure 7A:
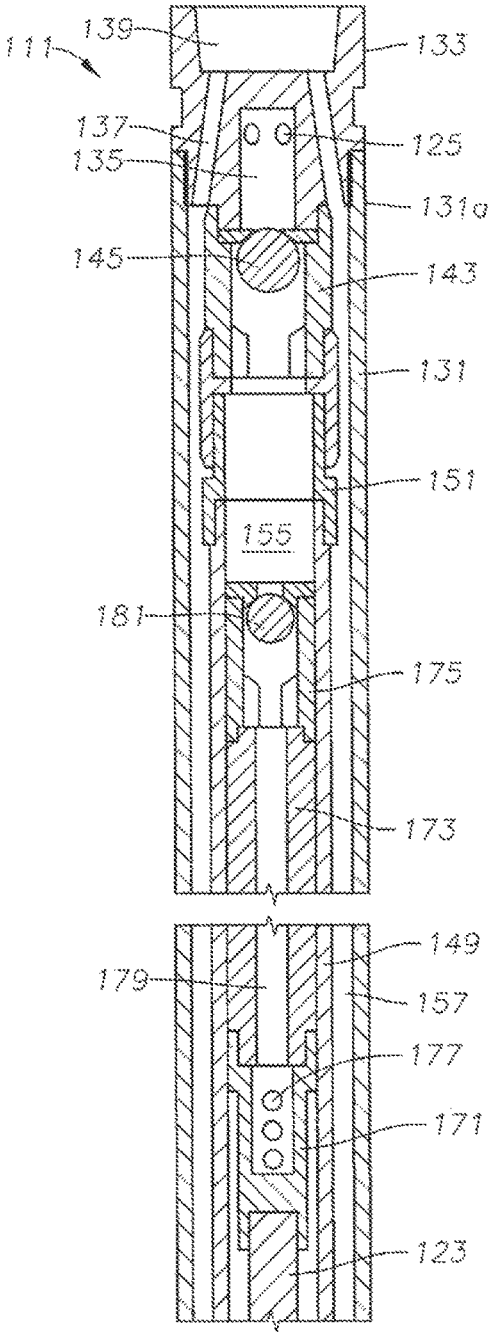
FIGS. 7A and 7B comprise a sectional view of the pump of the assembly of FIG. 6.
Figure 7B:
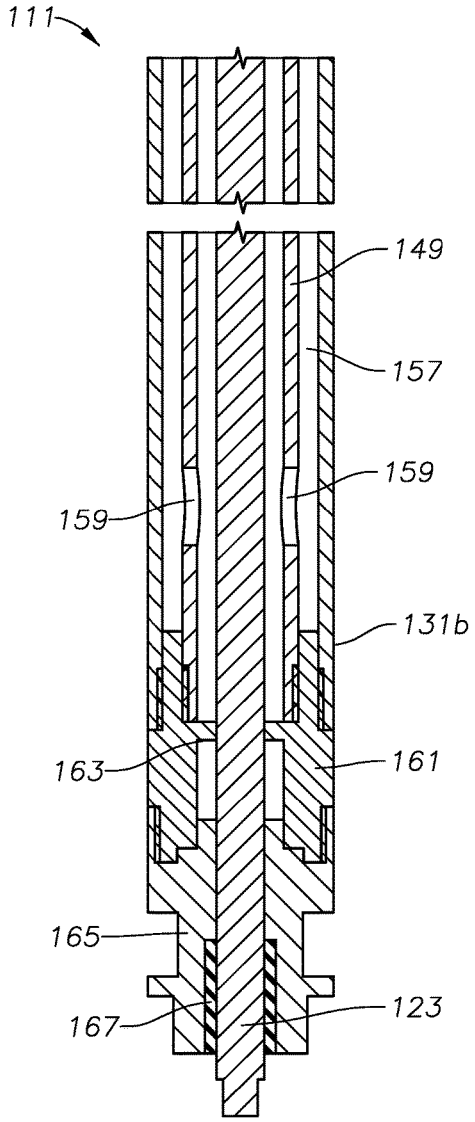
Figure 8:
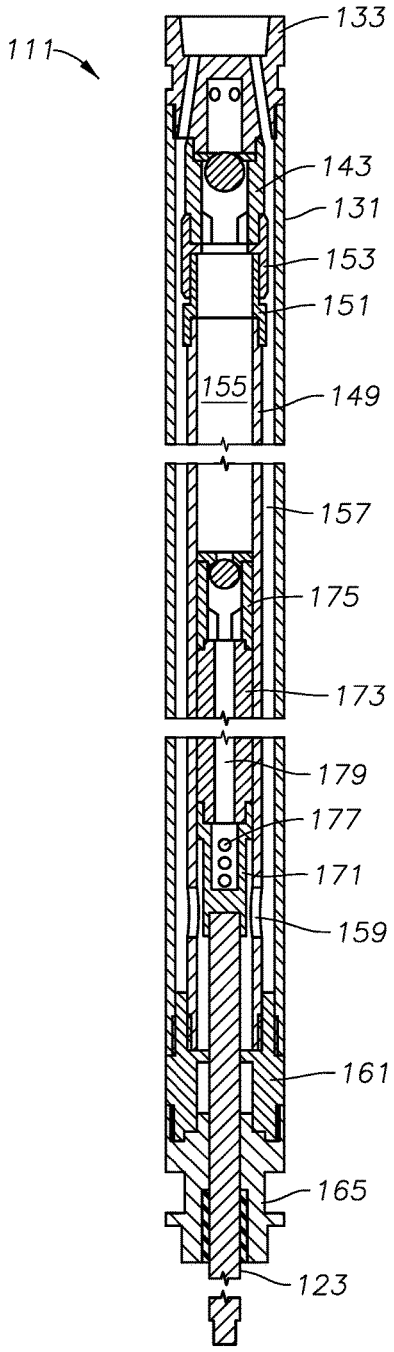
FIG. 8 is a sectional view of the pump of FIGS. 7A and 7B, showing the plunger in a different position.

A second embodiment of a pump is shown in FIGS. 6-8. Referring to FIG. 6, a reverse acting piston pump assembly 111 is disposed in a wellbore 113 along a generally vertical axis "A". Although pump assembly 111 is illustrated as being installed in a generally vertical section of wellborn 113, pump assembly 111 could alternatively be located within an inclined or horizontal section (not shown) of wellbore 113. Wellbore 113 is lined with casing 115 that is perforated or has openings 117 to exchange well fluid with the surrounding geologic formation "F".

Pump assembly 111 is illustrated as being supported on production tubing 119 extending into the wellbore 113 in an up-hole direction from the pump assembly 111. Alternately, pump assembly 111 could be supported by coiled tubing or another structure operable to carry well fluids to and from a surface location (not shown). Pump assembly 111 is coupled to a motor or actuator 121 disposed below, or down-hole with respect to the pump assembly 111. As described in greater detail below, actuator 121 is operable to axially move a connecting rod 123 of the pump assembly 111 in a reciprocating manner. Actuator 121 can include a submersible, rotary electric motor having a rotary to linear motion converter, and can be powered by an electric cable (not shown) extending to the surface location. In other embodiments, actuator 121 can include a hydraulic actuator, electrical linear motor, or other actuators operable to induce linear reciprocating motion of connecting rod 123.

In operation of the embodiment of FIGS. 6-8, actuator 121 is activated to move connecting rod 123 alternatingly on a down-stroke (in a down-hole direction) and on an upstroke (in an up-hole direction). As described in greater detail below, the down-stroke draws well fluid into the interior of pump assembly through inlet ports 125. The well fluid moving toward the inlet ports 125 between casing 115 and pump assembly 111 along arrows "L" defines a relatively low pressure flow. The wellbore fluid reverses direction upon entering the inlet ports 125. This reversal can induce gas to separate from liquid in the wellbore fluid, similar to the operation of a reverse flow gas separator, to minimize gas entering the pump assembly 111. The down-stroke also provides the pressure to discharge the well fluid from the pump assembly 111 into the production tubing 119. The well fluid moving into production tubing 119 along arrows "H" defines a relatively high pressure flow. During the upstroke, well fluids are exchanged within the pump assembly 111. A flow path through the pump assembly is described below.

As appreciated by those skilled in the art, the power or down-stroke places the connecting rod 123 in tension, while the fill or upstroke places the connecting rod in compression. The compression of the upstroke is not as great as the tension of the down-stroke since the upstroke serves primarily to exchange fluids within the pump assembly 111 in a "refilling cycle", whereas the down-stroke is the "power cycle" that energizes the well fluid to move up-hole through the production tubing 119. This arrangement mitigates the probability that the connecting rod 123 will buckle during operation, and thereby offers a reliable operation of the pump assembly 111.

Referring to FIGS. 7A and 7B, pump assembly 111 includes an annular pump housing 131 having an upper end 131*a* and a lower end 131*b*. Relative terms such as "upper", "lower" and the like are used herein only for convenience, since pump assembly 111 is also operable in horizontal or obliquely inclined orientations as described above. A pump head 133 is coupled to the upper end 131*a* of the pump housing 131. The pump head 133 includes a central interior chamber 135, which is fluidly coupled to inlet ports 125. Discharge ports 137 are defined through pump head 133 and radially spaced about interior chamber 135. The discharge ports 137 are fluidly coupled to a connector 139 defined in the head 133, which is provided for mechanically and fluidly coupling pump assembly 111 to production tubing 119 (FIG. 1).

A standing valve 143 is coupled to the pump head 133 and supported therefrom in a fixed or stationary manner within the pump housing 131. The standing valve 143 includes a closure member 145, which is operable to selectively permit or restrict flow of wellbore fluids from passing through the standing valve 143. As illustrated, closure member 145 is a ball that is passively operable to open and permit flow of wellbore fluid through standing valve 143 when a pressure below the standing valve 143 is less than a pressure above the standing valve 143, as will occur during the down-stroke. Conversely, closure member 145 passively closes against a seat when the pressure below the standing valve 143 is greater than the pressure above the standing valve 143 as occurs during the upstroke. Alternately, the closure member 145 could be a flapper, or other mechanism passively or actively controlled to open during the down-stroke, and close during the upstroke.

A pump barrel 149 extends below the standing valve 143 within the pump housing 131. The pump barrel 149 is a constructed of a tubular body having threads defined at upper and lower ends thereof. The threads at the upper end of the pump barrel 149 are engaged with a first adapter 151, which is coupled to the standing valve 143 by a second adapter 153. An internal cavity 155 is defined on an interior of pump barrel 149, and an annular passageway 157 is defined between the pump barrel 149 and the pump housing 131. The internal cavity 155 is fluidly coupled to the standing valve 143, and the annular passageway 157 is fluidly coupled to the discharge ports 137 defined in the pump head 133. Redirection ports 159 are defined through the tubular body of pump barrel 149, and are fluidly coupled to annular passageway 157. The threads at the lower end of the pump barrel 149 are engaged with a collar member 161.

Collar member 161 is also coupled to the lower end 131*b* of pump housing 131 by threads. The collar member 161 thus maintains a radial separation between the pump barrel 149 and the pump housing 131. Connecting rod 123 is radially surrounded by collar member 161, which, in some embodiments, can include guide flanges 163 such that collar member 161 serves as a bearing to support the reciprocating axial movement of the connecting rod 123. Collar member 161 supports a base member 165 at a lower end thereof. The base member 165 houses a seal 167 that engages the connecting rod 123 and operates to isolate wellbore fluids on tire exterior of the pump assembly 111 from relatively higher pressure wellbore fluids on an interior of the pump assembly 111. Seal 167 also operates to prohibit wellbore fluid from entering actuator 121 (FIG. 1). Seal 167 can include elastomeric o-rings, bellows members or other dynamic seal mechanisms known in the art for sealing about a reciprocating member.

Coupled to an upper end of connecting rod 123, is a perforated cylinder 171, a plunger 173 and a traveling valve 175. Each of the perforated cylinder 171, plunger 173 and traveling valve 175 reciprocate along with connecting rod 123 within pump barrel 149, and are closely fit within the pump barrel 149. Perforated cylinder 171 includes radial openings 177 defined therein through which wellbore fluid can pass. Plunger 173 includes an axial opening 179 extending therethrough which fluidly couples the perforated cylinder 171 and traveling valve 175. Traveling valve 175 includes a closure member 181, which is operable to open during the upstroke and close during the down-stroke. As illustrated, closure member 181 is a ball arranged below a seat such that a higher pressure below the ball, e.g., within axial opening 179, than above the ball, e.g., within internal cavity 155, induces the ball to seal against the seat. As described below, closure member 181 passively opens and closes in response to the differential pressure induced by the reciprocation of the connecting rod 123.

In operation, during the down-stroke, the connecting rod 123, perforated cylinder 171, plunger 173, and toweling valve 175 are all drawn downward by the actuator 121 (FIG. 1) from the configuration illustrated in FIGS. 7A and 7B toward the configuration illustrated in FIG. 8. At least since the plunger 173 is closely fit within the pump barrel 149, this downward motion pressurizes wellborn fluids below the closure member 181, and thereby maintains traveling valve 175 in a closed configuration during the down-stroke. The wellbore fluid below the closure member 181 is pushed downward and through redirection ports 159, where the wellbore fluid reverses direction into the annular passageway 157. At the top of the annular passageway 157, the wellbore fluid enters the discharge ports 137 defined in the pump head 133 and exits pump assembly 111. The discharged wellbore fluid flows into the production tubing 119 (FIG. 1), and up-hole toward the surface location.

Also during the down-stroke, a pressure vacuum or a reduced pressure is generated above the closure member 181 of the traveling valve 175. This creates a lower pressure in the internal cavity 155 above the traveling valve 175 than a pressure in the interior chamber 135 of the pump head 133. This differential pressure causes the closure member 145 to disengage its seat and permits wellbore fluid to flow through the standing valve 143. Wellbore fluid thus flows into the pump assembly 111 through inlet ports 125 and through the interior chamber 135 of the pump head 133, and then through the stationary valve 143. This flow of fluid fills the internal cavity 155 with wellbore fluid.

When the down-stroke is complete, the upstroke begins us the actuator 121 (FIG. 6) reverses the direction of the connecting rod 123, perforated cylinder 171, plunger 173 and traveling valve 175. This upward movement increases the pressure above the plunger 173, and thereby induces the closure member 181 to disengage its seat and open the traveling valve 175. This increase in pressure above the plunger 173 thereby induces the standing valve 143 to close, and causes wellbore fluid that entered the internal cavity 155 during the previous down-stroke to flow through the traveling valve 175 and through the axial opening 179 of the plunger 173. The upstroke thus causes the volume below the plunger to be refilled with wellborn fluid, and this fluid is produced on the subsequent down-stroke. The down-stroke and upstroke cycle is repealed to produce wellbore fluids up-hole.

Figure 9:
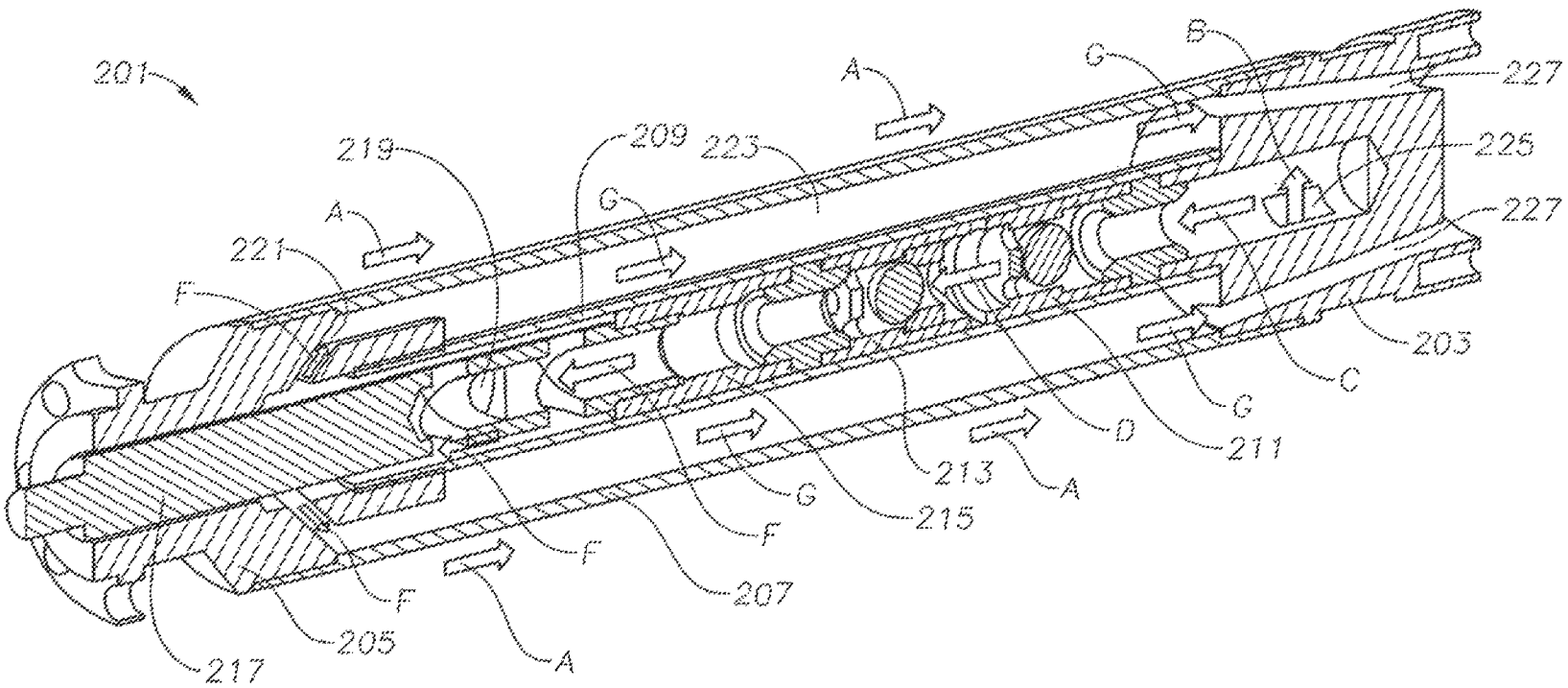
FIG. 9 is a perspective view of a third embodiment of a pump in accordance with this disclosure.

FIG. 9 illustrates a third embodiment of a pump. Although constructed differently, pump assembly 201 is similar in operation to pump assembly 111 described above. Pump assembly 201 includes a pump head 203 and a base member 205 supporting an outer annular pump housing 207 and inner annular pump barrel 209 therebetween. A standing valve 211 is coupled to the pump head 203, and a toweling valve 213 is coupled to a plunger 215 and a connecting rod 217. The connecting rod 217 can be coupled to an actuator 121 (FIG. 6) disposed below the pump assembly 201 as described above.

The connecting rod 217 includes radial openings 219 defined therein to permit the exchange of wellbore fluid from interior portions of the connecting rod 217 to an exterior of the connecting rod 217. Redirection ports 221 are defined in the base member 205, instead of in barrel 149 as redirection ports 159 (FIG. 7B) of the second embodiment. Redirection ports 221 are operable to redirect a downward flow of wellbore fluids from within pump barrel 209 to an upward flow in an annular passageway 223 defined between the bump barrel 209 and the pump housing 207.

In operation of the embodiment of FIG. 9, a first down-stroke allows a relatively low pressure fluid on an exterior of the pump housing 207 (arrows "A") to enter the pump assembly 201 through inlet ports 225 (arrow "B"). The low pressure fluid flow is redirected to a downward flow (arrow "C") where the fluid passes through an open standing valve 211 (arrow "D") to a closed traveling valve 213. A subsequent upstroke induces the traveling valve 113 to open to permit the low pressure fluid flow to pass the traveling valve 213 to a space defined below the plunger 213 (arrow "E"). A second down-stroke then pressurizes the fluid below the traveling valve 213 and induces a relatively high pressure fluid How downward and through redirection ports 221 (arrows "F"). The high pressure fluid flow continues through the annular passageway 223 and through discharge ports 227 (arrows "G"). The high pressure fluid flow can then continue up-hole through a conduit such as production tubing 119 (FIG. 6).

Figure 10A:
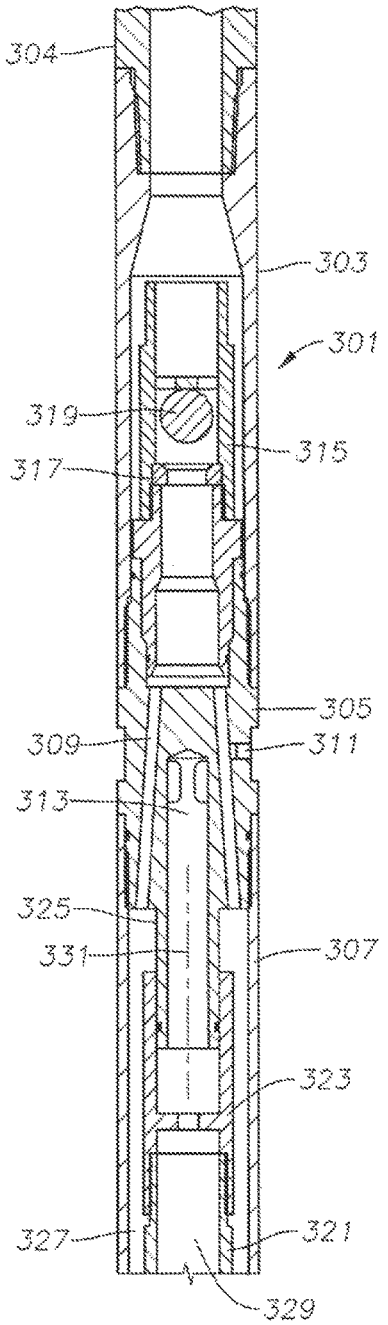
FIGS. 10A and 10B comprise a sectional view of a fourth embodiment of a pump in accordance with this disclosure.
Figure 11A:
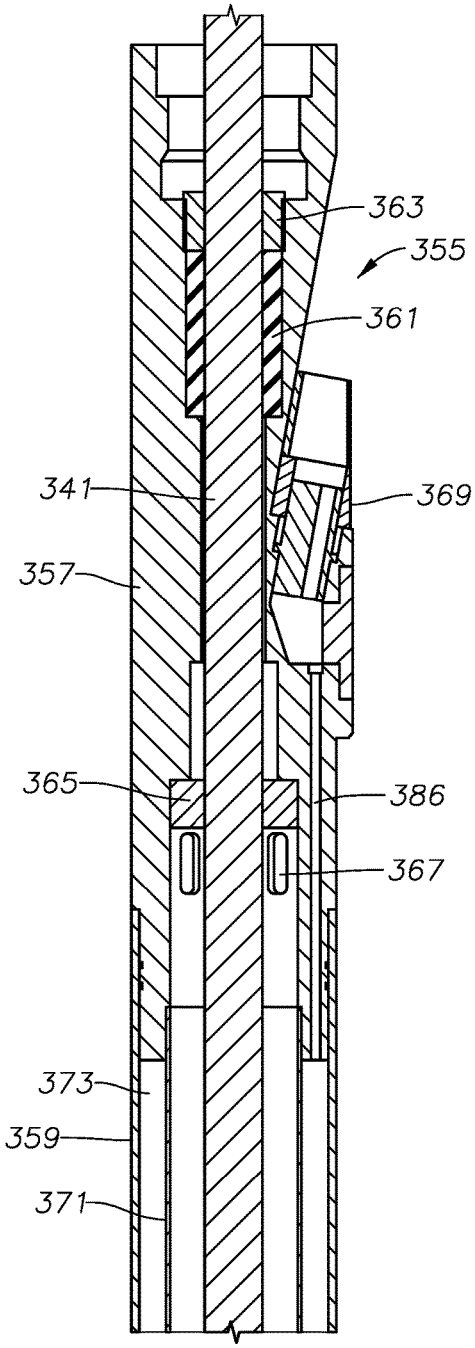
FIGS. 11A, 11B and 11C comprise a sectional view of a linear electrical motor coupled to the pump of FIGS. 10A and 10B.
Figure 11B:
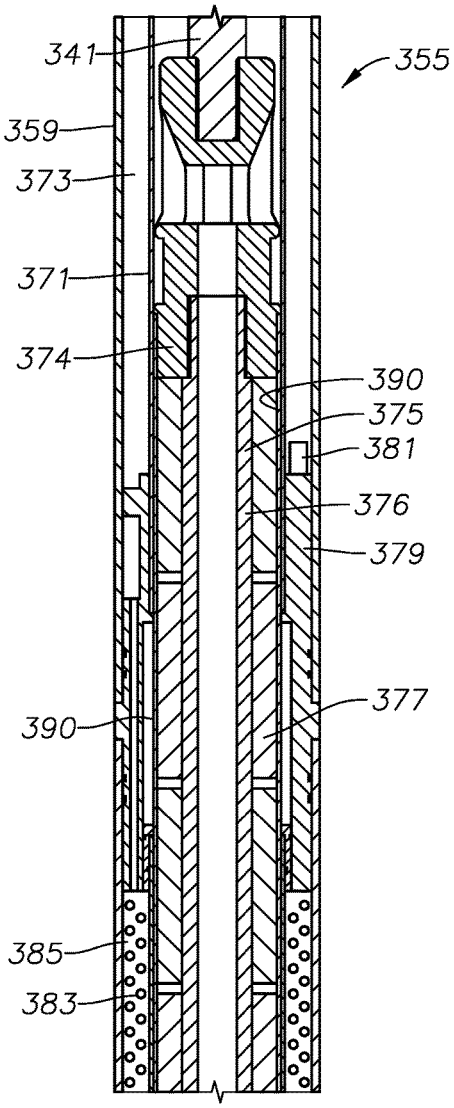
Figure 11C:
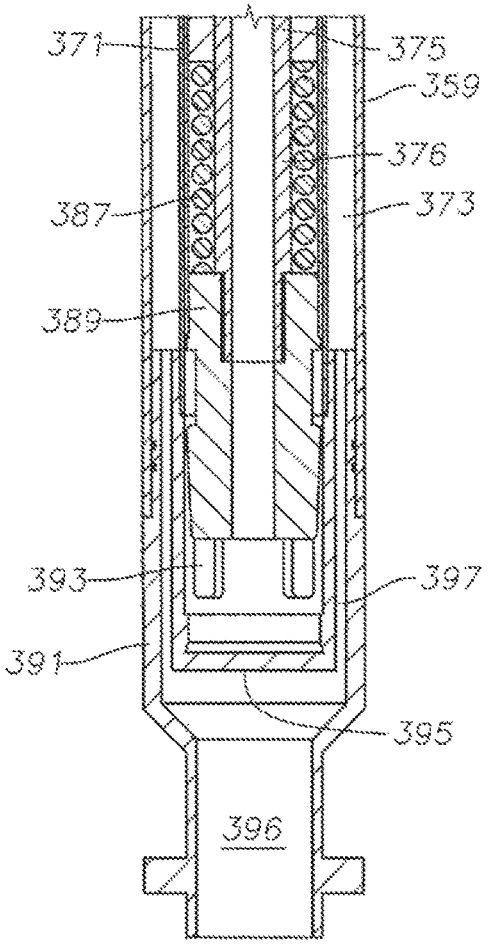
Figure 12:
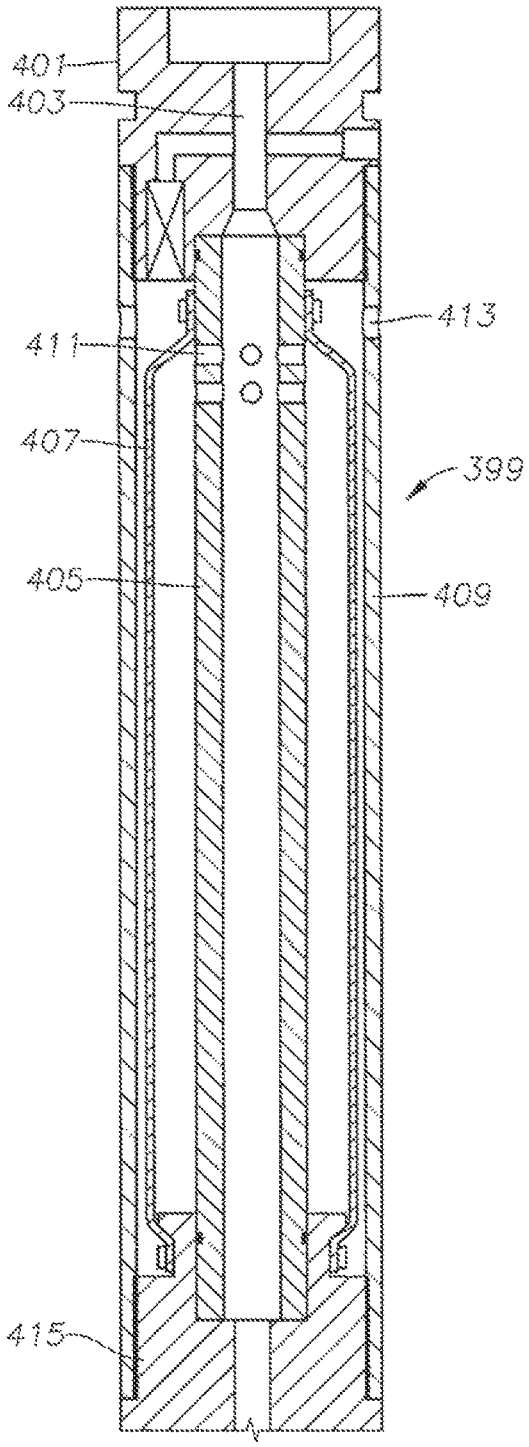
FIG. 12 is a sectional view of a portion of a an expansion chamber unit for use with the motor of FIGS. 11A-11C.

FIGS. 10-12 illustrate a fourth embodiment of a pump assembly. Referring to FIG. 10A, pump 301 has a discharge adapter 303 on an upper end that typically connects to a string of production tubing 304 leading upward to a well-head assembly. A pump head 305 secures with threads to discharge adapter 303. A cylindrical pump housing 307 secures with threads to pump head 305. Well fluid discharge ports 309 extend through pump head 305 from a lower end to an upper end. A well fluid intake or inlet port 311 extends from the exterior of pump head 305 to a central cavity 313 in pump head 305, central cavity 313 having a closed upper end within pump head 305.

A standing valve 315 secures to an upper end of pump head 305 within discharge adapter 303. Standing valve 315 has a lower seat 317 with a hall 319 below. When the pressure on hall 319 from above is higher than below, ball 319 closes, blocking downward flow from production tubing 304 into discharge ports 309. When the pressure on ball 319 from above is less than below, ball 319 opens to allow upward flow of well fluid from discharge ports 309 out the upper end of discharge adapter 303 into production tubing 304. Standing valve 315 has no effect on well fluid inlet 311, which may remain open at all times.

A cylinder or barrel 321 concentrically locates within pump housing 307. A collar 323 on the upper end of barrel 321 sealingly couples barrel 321 to a depending isolation tube 325 extending downward from pump head cavity 313. Barrel 321, which does not move within pump housing 307, defines an annular passageway 327 between barrel 321 and pump housing 307. Barrel 321 has an open bore 329 that is coaxial with a longitudinal axis 331 of pump 301. Collar 323 places well fluid from pump head cavity 313 in fluid communication with barrel bore 329.

Figure 10B:
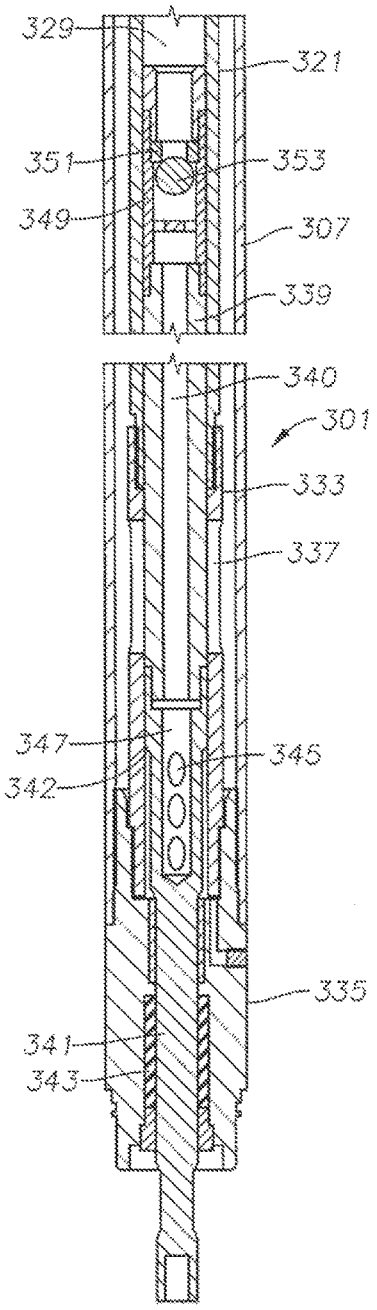

Referring to FIG. 10B, a lower end of barrel 321 connects to a barrel adapter 333, which may be considered to be a part of barrel 321. Barrel adapter 333 has a lower end that secures to a pump base 335, which secures to the lower end of pump housing 307. Redirect or outlet parts 337 extend through barrel adapter 333, creating a flow path for well fluid in barrel bore 329 to flow outward into a lower portion of annular passageway 327.

A plunger 339 slides sealingly within barrel bore 329 along axis 331. Plunger 339 has an axial plunger passage 340 extending therethrough. Plunger 339 is movable from the lower end of barrel bore 329 to the upper end. A connecting rod 341 has an upper end that secures to plunger 339 for moving plunger 339 in unison between an upstroke and a down-stroke. Seals 343 seal between connecting rod 341 and pump base 335. The upper end of connecting rod 341 has the same outer diameter as plunger 339. A downward facing shoulder 342 on connecting rod 341 separates the larger diameter portion of connecting rod 341 from a lower smaller outer diameter portion of competing rod 341. Shoulder 342 may be considered to be a lower end of plunger 339 in that any fluid in barrel 321 below shoulder 342 will be pushed downward during the down-stroke.

In this example, connecting rod 341 has plunger ports 345 located within a connecting rod cavity 347 at the upper end of connecting rod 341. Plunger ports 345 communicate well fluid in plunger passage 340 with well fluid in barrel bore 329. Alternately, plunger ports 345 could be located directly in the side wall of plunger 339.

A traveling valve 349 mounts to an upper end of plunger 339 for axial movement therewith. Traveling valve 349 has an upper seat 351 that is engaged by a ball 353 while plunger 339 is in down-stroke movement. The engagement closes traveling valve 349, causing downward movement of plunger 339 to push well fluid located in barrel bore 329 below plunger 339 outward. The outward flowing well fluid will flow through redirect ports 337 into annular passageway 327 until the lower end of plunger 339 passes below redirect ports 337. During the upstroke, traveling valve 349 opens, allow well fluid that has entered barrel bore 329 above plunger 339 to flow through traveling valve 349 and out plunger ports 345 info the portion of barrel bore 329 below plunger 339.

During the down-stroke of plunger 339, well fluid is pumped upward in annular passageway 327 out discharge adapter 303 to lift the column of well fluid in production tubing 304. The down-stroke may be considered to be a power stroke, and during the down-stroke, plunger 339 moves in an opposite direction to the flow of well fluid into production tubing 304. During the down-stroke, traveling valve 349 closes. Plunger 339 pushes well fluid that previously entered barrel bore 329 below plunger 339 out redirect ports 337 until shoulder 342 passes below redirect ports 337 near the end of the down-stroke. The well fluid flowing into annular passageway 327 will be pushed upward through discharge ports 309 and through standing valve 315, which is open during the down-stroke.

During the upstroke, traveling valve 349 will open, allowing fluid that enters intake port 311 to flow into bore barrel 329 above plunger 339. This incoming well fluid flows downward through traveling valve 333 into plunger passage 340. The incoming well fluid flows downward in plunger passage 340 out plunger ports 345 into barrel bore 329 below plunger 339. The well fluid entering barrel bore 329 will be in fluid communication with the well fluid in annular passageway 327. The upstroke thus replenishes well fluid in barrel bore 329 below plunger 339. Standing valve 315 will be closed during the upstroke, blocking downward flow of well fluid in production tubing 304. When plunger 339 reaches the top of the upstroke, connecting rod 341 reverses, starting another down-stroke.

During the down-stroke, connecting rod 341 will be moving downward and will be in tension. During the upstroke, connecting rod 341 will be in compression, but the level of compression is far less than the tension because pump 301 is not lifting a column of well fluid during the upstroke.

FIGS. 11A-C illustrate an example of a linear motor 355 for stroking connecting rod 341. Linear motor 355 has a head 357 that connects to the lower end of pump 301 (FIGS. 10A and 10B) in this embodiment. A cylindrical outer housing 359 secures with threads to a lower end of motor head 357. A seal 301 seals around the reciprocating connecting rod 341, the seal being retained by a retaining nut 363. Motor head 357 has a mover stop 365 that limits upward movement of connecting rod 341 beyond the top of the upstroke. Motor well fluid ports 367 extend through motor head 357 below seal 361 to admit well fluid to a central portion of the interior of motor outer housing 339. An electrical connector 369 in motor head 357 connects to a motor lead of a power cable (not shown) to supply electrical power to linear motor 355.

A cylindrical inner housing 371 has an upper end that secures to motor head 357. Inner housing 371 is concentrically located in outer housing 359 and has a smaller outer diameter than the inner diameter of outer housing 3591 defining an annular chamber 373. Inner housing 371 is formed of a nonmagnetic material, which may be a metal or a composite material. Well fluid is admitted to the interior of inner housing 371 via well fluid ports 367 in motor head 357.

A lower end of connecting rod 341 secures to a mover head 374, as shown in FIG. 11B. Mover head 374 is part of a mover 376, which includes a shaft or inner tube 375 carried concentrically with inner housing 371 and of a smaller outer diameter than mover head 374. Permanent magnets 377 are mounted around and extend along a length of inner tube 375. Mover head 374 is only slightly smaller in outer diameter than the inner diameter of inner housing 371. Mover inner tube 375 may receive well fluid in its interior.

Outer housing 359 is illustrated as being in sections. A sensor and bearing connector 379 connects an upper section of outer housing 359 to a next lower section of outer housing 359. Sensor and bearing connector 379 has an inner diameter that fits closely around inner housing 371 to provide radial support. In this example, inner housing 371 extends continuously throughout the length of linear motor 355, but it also could be formed in sections. A sensor 381 mounts to sensor and bearing connector 379 within a lower end of annular chamber 373. Sensor 381 detects the proximity of a portion of mover 376 to determine the top of the upstroke and tire bottom of the down-stroke. Sensor 381 may be a Hall effect magnetic sensor that transmits a magnetic field inward across inner housing 371 to detect the approach of mover head 374 as mover 376 nears the bottom of the down-stroke. Additional connectors (not shown) similar to sensor and bearing connector 379 may connect additional segments of outer housing 359. Those connectors would not need to have sensors 381.

A number of electromagnetic coil windings 383 are located in an annular windings chamber 385. Windings chamber 385 comprises an annular space between inner housing 371 and a segment of outer housing 359 extending downward from sensor and bearing connector 379. The upper end of windings chamber 385 is defined by sensor and bearing connector 379. Windings chamber 385 is filled with a dielectric liquid or fluid that immerses coil windings 383. A passage (not shown) in sensor and bearing connector 379 communicates dielectric thud in chamber 385 with dielectric fluid in annular chamber 373. When supplied with electrical pulses, coil windings 383 emit electromagnetic fields across inner housing 371 to interact with mover magnets 377 and cause mover 376 to stroke. Coil windings 383 do not extend a full length of windings chamber 385. The axial length of mover magnets 377 is greater than the axial length of coil windings 383. The electrical wires (not shown) for coil windings 383 extend from electrical connector 369 (FIG. 11A), through a wire passage 386 to annular chamber 373. The electrical wires extend through passages in sensor and bearing connector 379 (FIG. 11B) to coil windings 383.

Referring to FIG. 11C, a coil spring 387 encircles a lower end of mover inner tube 375 and supports the lower end of the array of mover magnets 377. A mover base 389 of larger diameter than mover inner tube 375 supports coil spring 387. Coil spring 387 is under compression between mover base 389 and mover magnets 377, urging the array of mover magnets 377 against mover head 374 (FIG. 11B). Mover magnets 377 are axially slidable on mover inner tube 375, and the bias of coil spring 387 accommodates thermal expansion that occurs between the different materials of mover inner tube 375 and mover magnets 377.

A thin magnet sleeve 390 encloses mover magnets 377 and extends from mover base 389 (FIG. 11C) to mover head 374 (FIG. 11B). Magnet sleeve 390 moves in unison with mover 376 and slides within motor inner housing 371. Magnet sleeve 390 protects protection to magnets 377 against wear and is not sealed from well fluid located within motor inner housing 371.

A motor base 391 secures with threads to a lower end of the lowest segment of outer housing 359. The lower end of inner housing 371 seals to a counterbore in motor base 391. A well fluid port 393 extends into motor base 391 to admit well fluid into the interior of inner housing 371 as well as the inferior of mover tube 375. Motor base 391 has a transverse barrier wall 395 below well fluid port 393 that closes the interior of inner housing 371 from a central passage 396 in motor base 391 located below. Motor base 391 has dielectric fluid passages 397 that extend from central passage 396 into windings chamber 385.

Referring to FIG. 12, an expansion chamber unit 399 secures to motor base 391 in this embodiment. Expansion chamber unit 399 has a head 401 that secures to motor base 391, either with a threaded rotatable collar or bolts. Expansion chamber head 401 has an axially extending dielectric fluid passage 403 that communicates with motor base cavity 396. A guide tube 405 extends coaxially downward from expansion chamber head 401 in registry with dielectric fluid passage 403. A movable member, such as a flexible elastomeric bag 407 encircles guide tube 405. Alternately, the movable member could be a bellows or a piston. An expansion chamber housing 409 surrounds bag 407 and connects to expansion chamber head 401. Bag 407 is filled with a dielectric fluid, and guide tube ports 411 communicate that fluid between bag 407 and windings chamber 385 via passages 403, 396 and 397. A well fluid inlet 413 in expansion chamber housing 409 admits well fluid to the exterior side of bag 407. Bag 407 seals dielectric fluid in its interior from the well fluid in housing 409 and equalizes the pressure of the dielectric fluid in windings chamber 385 with the hydrostatic pressure of well fluid.

A lower connector 415 secures to the lower end of housing 409. Additional segments of housing 409 and additional bags 407 may be mounted below lower connector 415 in tandem. Alternately, lower connector 415 could be configured to comprise the lower end of expansion chamber unit 399. The upper end of bag 407 seals around guide tube 405 above guide tube ports 411. The lower end of bag 407 seals around lower connector 415.

When pump assembly 301 is deployed in the well, the temperature of the well fluid often increases with depth. The increasing temperature causes thermal expansion of the dielectric fluid contained within windings chamber 385. Also, when linear motor 355 operates, more heat is generated, causing thermal expansion of the dielectric fluid in windings chamber 385, annular chamber 373 and electrical wire passage 386 (FIG. 11A-C). The thermal expansion is accommodated by allowing hag 407 to expand. When linear motor 355 is shut off, it will cool, causing the dielectric fluid to contract thermally. Bag 407 contracts to accommodate the contraction.

A controller (not shown) at the surface adjacent the wellhead will supply a first pulse, preferably DC, to coil windings 383, causing mover 376 to stroke connecting rod 341 in a first direction. Assuming the first direction to be an upstroke, when near the top of the upstroke stroke, sensor 381 will detect the proximity of mover base 389, and provide a signal to the controller. The controller reverses the polarity to coil windings 383, causing mover 376 to begin the down-stroke of connecting rod 341. When nearing the bottom of the down-stroke, sensor 381 will detect the proximity of mover head 374, and provide a signal to the controller to again reverse the direction.

The pump assembly may also have various additional sensors (or detecting well fluid conditions. For example, a significant reduction in amperage being sent to linear motor 355 may indicate that a large gas bubble in the well fluid is flowing into pump 301. The controller may in response take various remedial actions, such as providing much more rapid pulses to cause vibration of the pump assembly to break up the gas bubble. Another remedial action may be to stop powering linear motor 355 for a selected time to allow the gas bubble to dissipate.

While the invention has been shown only in a few of its forms, it should be apparent to those skilled in the art that it is not so limited but is susceptible to various changes.

The invention claimed is:

1. A submersible well pump assembly, comprising:

a pump housing having a longitudinal axis and a pump discharge on an upper end;

a pump barrel located within the pump housing, defining an annular passage between the barrel and the pump housing;

a plunger reciprocally carried in the barrel between an up stroke and a down stoke, the plunger having a plunger cavity;

a well fluid inlet in the housing configured to admit well fluid into the barrel above the plunger;

a traveling valve on an upper end of the plunger that moves with the plunger, the traveling valve having an open position during the up stroke to admit well fluid in the barrel above the plunger into the plunger cavity;

a plunger port in a lower portion of the plunger cavity that communicates well fluid in the plunger cavity with the barrel below the plunger;

a barrel port that communicates well fluid in the barrel below the plunger with the annular passage;

a standing valve in the pump discharge having a lower side in fluid communication with the annular passage, the standing valve having an open position during the down stroke to flow well fluid from the annulus into the pump discharge; and a motor mounted to a lower end of the pump housing and operatively coupled to the plunger for causing the plunger to reciprocate between the up stroke and the down stroke.

2. The assembly according to claim 1, wherein the standing valve is located above the well fluid inlet.

3. The assembly according to claim 1, wherein the motor comprises:

a motor outer housing;

a motor inner housing mounted concentrically in the motor outer housing, the motor inner housing having a smaller outer diameter than an inner diameter of the motor outer housing, defining a windings chamber;

a coil winding within the windings chamber; and a mover located within the motor inner housing, the mover comprising a shaft with a plurality of magnets extending along a length of the shaft, wherein electrical power supplied to the coil winding causes the mover to move linearly along the axis, the mover being operatively coupled to the plunger for causing the up stroke and down stroke of the plunger.

4. The assembly according to claim 1, wherein the well fluid inlet is located above the barrel and is continuously open.

5. The assembly according to claim 1, further comprising:

a downward facing piston shoulder on an exterior of the plunger above the plunger port for pushing well fluid in the barrel below the plunger out the barrel port into the annular passage during the down stroke.

6. The assembly according to claim 1, wherein the plunger port and the barrel port are continuously open.

7. The assembly according to claim 1, wherein the motor comprises:

a motor outer housing;

a motor inner housing mounted concentrically in the motor outer housing, the motor inner housing having a smaller outer diameter than an inner diameter of the motor outer housing, defining a windings chamber;

a coil winding within the windings chamber;

a mover located within the motor inner housing, the mover comprising a shaft with a plurality of magnets extending along a length of the shaft, wherein electrical power supplied to the coil winding causes the mover to move linearly along the axis, the mover being operatively coupled to the plunger for causing the and up stroke and the down stroke of the plunger;

an expansion chamber coupled to the motor outer housing, the expansion chamber having a movable element and containing a dielectric fluid, the movable element being movable in response to a difference between well fluid pressure exterior of the expansion chamber and a pressure of the dielectric fluid; and a dielectric fluid communication passage leading from the expansion chamber into the windings chamber, immersing the winding in the windings chamber in the dielectric fluid.

8. The assembly according to claim 7, further comprising:

a motor well fluid passage extending into the interior of the motor inner housing, immersing the mover in well fluid.

9. The assembly according to claim 1, further comprising:

a discharge port within the housing and inclining inward towards the axis in an upward direction from the annular passage toward the lower side of the standing valve.

10. A submersible well pump assembly, comprising:

a pump housing having a longitudinal axis, a well fluid inlet and a well fluid discharge;

a pump barrel located within the pump housing, defining an annular passage between the barrel and the pump housing, the annular passage being in fluid communication with the well fluid discharge, the barrel having an intake end in fluid communication with the well fluid inlet;

a plunger reciprocally carried in the barrel, the plunger having a piston shoulder facing opposite the intake end of the barrel, and the plunger being movable between a power stroke and an intake stroke;

a barrel outlet port that communicates well fluid from the barrel on a power end of the plunger into the annular passage;

a plunger passage extending axially within the plunger, the plunger passage having an intake end and discharge end;

a plunger port communicating the discharge end of the plunger passage with the barrel and the barrel outlet port to flow well fluid from the plunger passage out the barrel outlet port;

a traveling valve carried by the plunger at the intake end of the plunger passage, the traveling valve closing the intake end of the plunger passage during the power stroke, thereby with the piston shoulder, pushing well fluid out the barrel outlet port into the annular passage and from the annular passage out the well fluid discharge;

the traveling valve opening the plunger passage during the intake stroke, thereby allowing well fluid to flow into the plunger passage from the intake end of the barrel; and a motor mounted to an end of the pump housing opposite the well fluid discharge and operatively coupled to the plunger by a connecting rod, the motor reciprocating the rod to cause the plunger to move between the power stroke and the intake stroke, the connecting rod being in tension during the power stroke.

11. The assembly according to claim 10, wherein the plunger port in continuously open.

12. The assembly according to claim 10, wherein the barrel outlet port is continuously open.

13. The assembly according to claim 10, further comprising:

a standing valve in the well fluid discharge of the housing.

14. The assembly according to claim 10, wherein the well fluid inlet is open both during the power stroke and the intake stroke.

15. The assembly according to claim 10, wherein the motor comprises:

a motor outer housing;

a motor inner housing mounted concentrically in the motor housing, the motor inner housing having a smaller outer diameter than an inner diameter of the motor outer housing, defining a windings chamber;

coil windings within the windings chamber and immersed within a dielectric fluid contained in the windings chamber;

a mover secured to the connecting rod and located within the inner housing, the mover comprising a shaft having a plurality of magnets extending along a length of the shaft, wherein electrical power supplied to the coil windings causes the mover to move linearly along the axis;

an expansion chamber coupled to the motor outer housing, the expansion chamber having a movable element having one side in contact with a dielectric fluid and an opposite side exposed to well fluid exterior of the assembly, the movable element being movable to reduce a pressure differential between the dielectric fluid and the well fluid pressure;

a dielectric fluid communication passage leading from the expansion chamber into the windings chamber in fluid communication with the dielectric fluid in the windings chamber; and a motor well fluid passage extending into the interior of the inner housing, immersing the mover in well fluid.

16. A submersible well pump assembly, comprising:

a pump housing having a longitudinal axis, a well fluid inlet and a well fluid outlet located coaxially with the axis above the well fluid inlet;

a pump barrel within the pump housing, defining an annular passage between the barrel and the pump housing;

a plunger reciprocally carried in the barrel and movable between a down stroke and an up stroke, the plunger having a plunger cavity therein;

a well fluid inlet in the housing defining a well fluid inlet path that admits well fluid into the barrel above the plunger;

a traveling valve on an upper end of the plunger cavity that moves with the plunger, the traveling valve having an open position that admits well fluid from the barrel above the plunger into the plunger cavity during the up stroke, and the traveling valve having a closed position during the down stroke;

a plunger port in a lower end of the plunger cavity in fluid communication with the barrel below the plunger for flowing well fluid in the plunger cavity into the barrel below the plunger;

a barrel outlet port that defines a well fluid outlet path communicating well fluid from the barrel below the plunger with the annular passage;

a standing valve in the well fluid outlet above the well fluid inlet;

a discharge port leading from the annular passage to a lower side of the standing valve, the standing valve having a closed position during the up stroke and an open position during the down stroke; and a motor mounted to a lower end of the pump housing and operatively coupled to a lower end of the plunger by a connecting rod, the motor reciprocating the rod to cause the plunger to move between the up stroke and the down stroke.

17. The assembly according to claim 16, wherein an inlet path from the well fluid inlet into the barrel above the plunger is continuously open.

18. The assembly according to claim 16, further comprising:

a downward facing piston shoulder on an exterior of the plunger above the plunger port for pushing well fluid in the barrel below the plunger out the barrel outlet port into the annular passage during the down stroke.

19. The assembly according to claim 16, wherein the plunger port and the barrel outlet port are continuously open.

20. The assembly according to claim 16, wherein the motor comprises:

an annular windings chamber having a central bore;

a coil winding within an annular windings chamber;

a mover having magnets that reciprocates within the bore in response to electrical power supplied to the coil winding, the mover being connected to the connecting rod;

an expansion chamber coupled to the motor having a movable element and a dielectric fluid, the movable element being movable in response to a difference between well fluid pressure exterior of the expansion chamber and a pressure of the dielectric fluid; and a dielectric fluid communication passage leading from the expansion chamber into the windings chamber that immerses the windings in the dielectric fluid.

* * * * *